US005881978A

United States Patent [19]

Rust

[11] Patent Number: 5,881,978

[45] Date of Patent: Mar. 16, 1999

[54] ANCHOR LOCKING DEVICE

[76] Inventor: Marcus D. Rust, 6393 W. 600 South, Remington, Ind. 47977

[21] Appl. No.: 72,647

[22] Filed: May 5, 1998

[51] Int. Cl.[6] ..... A45F 3/44

[52] U.S. Cl. ..... 248/156; 40/607; 109/52; 248/552

[58] Field of Search ..... 248/156, 545, 248/552, 507; 70/234, 235; 109/52; 40/607

[56] References Cited

U.S. PATENT DOCUMENTS

| | | | |
|---|---|---|---|
| 2,552,745 | 5/1951 | Stanley et al. | 40/145 |
| 4,130,957 | 12/1978 | Hampton | 40/607 |
| 4,249,715 | 2/1981 | Repp | 248/545 |
| 4,378,650 | 4/1983 | Ottoson | 40/607 |
| 4,753,411 | 6/1988 | Lechner et al. | 248/156 X |
| 5,098,057 | 3/1992 | Gran et al. | 248/156 X |
| 5,113,627 | 5/1992 | Jarret, Sr. | 248/156 X |
| 5,139,219 | 8/1992 | Navarro | 248/156 X |
| 5,207,402 | 5/1993 | Berry-Tremmel et al. | 248/156 |
| 5,501,086 | 3/1996 | Sherlock | 70/58 |

*Primary Examiner*—Ramon O. Ramirez

*Attorney, Agent, or Firm*—Woodard, Emhardt, Naughton Moriarty & McNett

[57] ABSTRACT

The present invention relates to a ground anchor incorporating a sliding lockable wedge portion upon a vertical post having an auger, screw, or drill flight formed thereon, wherein substantial relative motion between an outdoor item and a ground surface may be releasably prevented. The auger may be used to easily drill the post into the ground and, once installed, the sliding wedge portion may be moved down the post shaft and forced down such that the projecting wedge fins are driven into the surface of the earth. The sliding wedge portion is then coupled to the shaft having the auger portion. Such a combination will prevent the vertical post from rotating about its axis, which is desirable in that it prevents the post from rotating in the wind and prevents unauthorized removal of the post, or any item attached to the post, because the projecting wedge fins prevent the post from being unscrewed from the ground. When it is desired for the anchor locking device to be removed by an authorized user, the sliding wedge portion is uncoupled from the vertical auger post, the wedge fins are removed from the ground, and the vertical post may then be unscrewed from the ground.

18 Claims, 4 Drawing Sheets

ANCHOR LOCKING DEVICE

TECHNICAL FIELD OF THE INVENTION

The present invention generally relates to anchors for securing objects to the ground and, more particularly, to an anchor locking device.

BACKGROUND OF THE INVENTION

There exist numerous prior art designs for ground anchors, usually in the form of posts that are to be secured into the ground and that are adapted for the mounting of a sign or the like thereon. Many of these prior art devices incorporate features that make them more useful than simple stakes driven into the ground. For example, U.S. Pat. No. 5,207,402 to Berry-Tremmel et al. discloses a support frame for a sign that includes a spiraled surface about the sign mounting stake which may be used to screw the sign into the ground by rotating the sign about the axis of the stake. Additionally, U.S. Pat. No. 4,378,650 to Ottoson discloses a signpost having a pair of triangular fins extending therefrom that are situated below the surface of the ground when the signpost is mounted into the ground. These projecting fins prevent the sign from being twisted about the axis of the mounting stake (such as by wind and the like) because of interaction between the fins and the earth.

While such prior art devices provide desirable features, these desirable features have previously been considered to be mutually exclusive in that a signpost cannot have both a spiraled surface for screwing the stake into the ground and fins projecting from the stake. This is because, according to the teachings of the prior art, the fins would prevent the stake from being screwed into the ground.

There is therefore a need for a ground anchor that permits the use of both an integral auger for ease in screwing the anchor into the ground and projecting fins for preventing unwanted rotation of the anchor after installation. The present invention is directed toward meeting this need.

SUMMARY OF THE INVENTION

The present invention relates to a ground anchor incorporating a sliding lockable wedge portion upon a vertical post having an auger or drill flight formed thereon, wherein a sign or the like may be mounted upon the post. The auger may be used to easily drill the post into the ground and, once installed, the sliding wedge portion may be moved down the post shaft and forced down such that the projecting wedge fins are driven into the surface of the earth. The sliding wedge portion is then coupled to the shaft having the auger portion.

Such a combination prevents the sign from being rotated about the axis of the signpost, which imparts the desirable features of preventing the sign from being rotated in the wind and further prevents unauthorized removal of the sign because the projecting wedge fins prevent the signpost from being unscrewed from the ground. When it is desired for the sign to be removed by an authorized user, the sliding wedge portion is uncoupled from the vertical auger post and the wedge fins are removed from the ground, thereby allowing the vertical post to be unscrewed from the ground.

DESCRIPTION OF THE PREFERRED EMBODIMENTS

Figure 1:
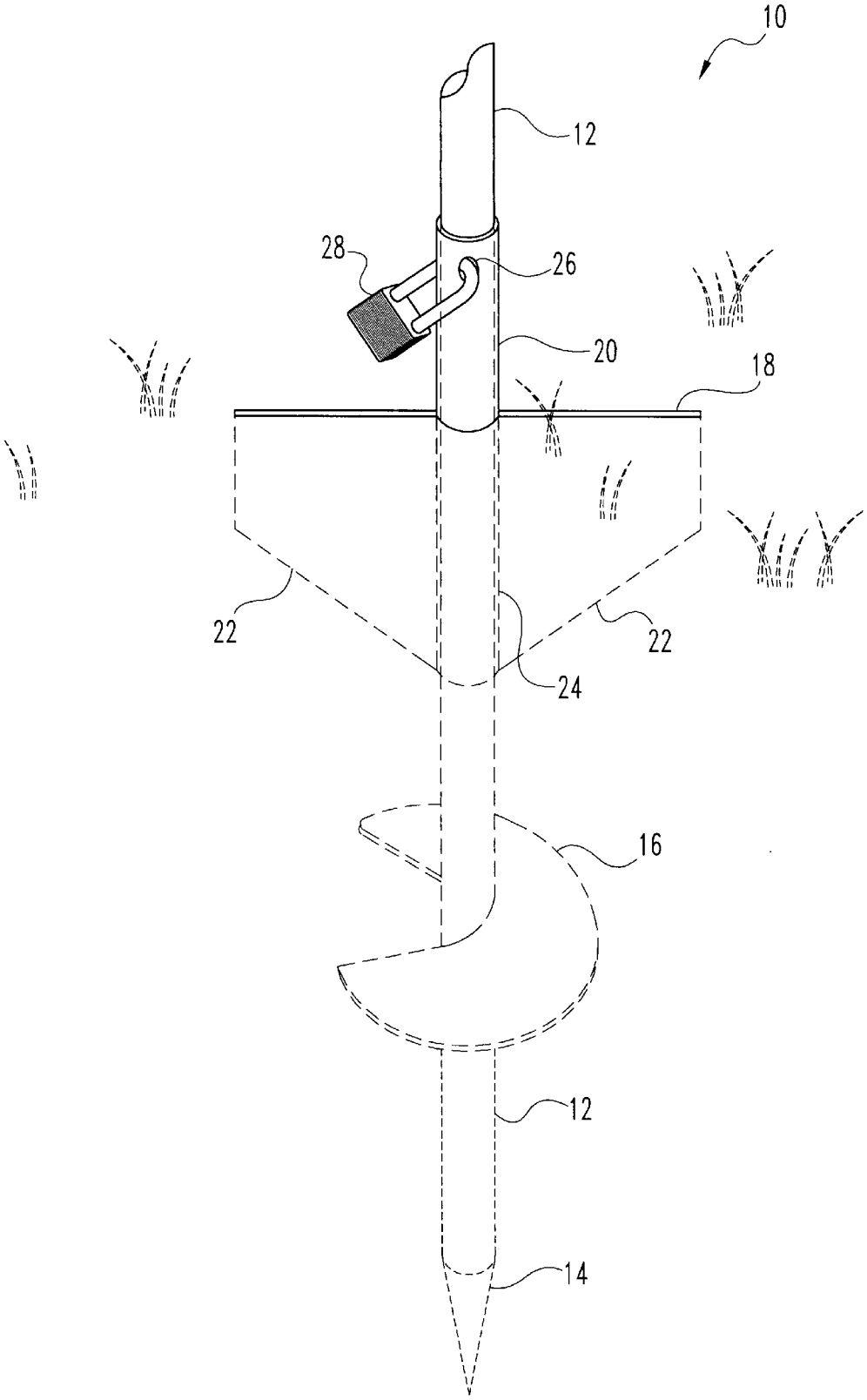
FIG. 1 is a perspective view of a first embodiment of the present invention mounted into the ground.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and farther modifications in the illustrated device, and such further applications of the principles of the invention as illustrated therein being contemplated as would normally occur to one skilled in the art to which the invention relates.

Referring to FIG. 1, there is illustrated a first embodiment of the present invention, indicated generally at 10. The anchor locking device 10 comprises a vertical post 12 that is adapted for mounting a sign or the like (not shown) thereon. The vertical post 12 preferably has a pointed distal tip 14. Mounted upon the vertical post 12 (or formed integrally therewith) is an auger, screw, or drill flight 16.

Although the auger 16 of FIG. 1 is illustrated as executing a spiral of approximately 360 degrees, the present invention comprehends the use of an auger 16 which does not execute a full revolution or which executes multiple revolutions about the vertical post 12. The present invention also comprehends the use of a vertical post 12 having a screw formed integrally therewith in place of or in addition to the auger 16. It is simply desired that the auger 16 act to pull the vertical post 12 down into the ground as the vertical post 12 is rotated about its longitudinal axis. The inclusion of the auger 16 upon the vertical post 12 therefore greatly facilitates insertion of the vertical post 12 into the ground, particularly when it is desired to drive the vertical post 12 into relatively hard and compacted soil, or when it is desired that the vertical post 12 extend to a relatively great depth below the surface.

The anchor locking device 10 of FIG. 1 further includes a sliding lockable wedge 18 that is coaxially mounted in sliding relationship with the vertical post 12. In the first embodiment of FIG. 1, the wedge 18 includes a central cylindrical collar portion 20 with an interior shaft having an inside diameter that is greater than the outside diameter of the vertical post 12, thereby enabling the portion 20 to slide over the vertical post 12. Additionally, the wedge 18 incorporates a pair of diametrically opposed fins 22 extending therefrom, although the present invention comprehends the use of one or more such fins, one or more stakes, or the like. Each fin 22 further preferably has its maximum length at the junction 24 between the fin 22 and the central portion 20, this length decreasing linearly with increasing distance from the junction 24. Such a configuration for the fin 22 facilitates insertion of the fin 22 into the ground.

In operation, the vertical post 12 is driven into the surface of the earth until the auger portion 16 rests upon the surface. The vertical post 12 is then turned in a clockwise direction, which forces the auger blade 16 into the surface of the earth. Further turning of the vertical post 12 causes it to be pulled into the earth by action of the auger 16. Once the vertical post 12 has been inserted to the desired depth below the surface, the sliding wedge portion 18 is slid down the vertical post 12 and forced into the surface of the earth until the fins 12 are substantially immersed therein. This is preferably accomplished by applying pressure to the upper surface of each fin 22 with the user's feet.

Once the wedge portion 18 has been inserted into the earth, a pair of diametrically opposed holes 26 in the central portion 20 are aligned with holes (not shown) formed into the vertical post 12. Once the holes between the vertical post 12 and the central portion 20 have been aligned, a retaining device 28 may be inserted therethrough in order to prevent further relative movement between the sliding wedge 18 and the vertical post 12. For example, the embodiment of FIG. 1 illustrates a padlock being used to secure the sliding wedge 18 to the vertical post 12.

The foregoing arrangement provides several advantages over prior art ground anchors. First, because the sliding lockable wedge portion 18 may be moved with respect to the vertical post 12, it does not interfere with operation of the auger 16 when the vertical post 12 is being screwed into the ground. After the vertical post 12 has been properly positioned, the slidable locking wedge portion 18 may be moved down the vertical post 12 and inserted into the ground. If the wedge portion 18 were permanently affixed to the vertical post 12, it would prevent boring of the vertical post 12 into the ground to a depth that would place the fins 22 below the surface of the ground. However, with the two step procedure allowed by the device 10 of FIG. 1, a ground anchor for mounting signs or the like may be provided that allows the post to be bored into the ground and the wedge 18 to be incorporated in order to prevent inadvertent rotation of the anchor 10 about its longitudinal axis. This will prevent the sign from inadvertently twisting when subjected to forces such as wind loading.

A further advantage of the anchor locking device 10 of FIG. 1 results from the fact that the wedge 18, once inserted into the ground, prevents rotation of the auger 16. The wedge 18 therefore prevents the sign from being removed from the ground because the vertical post 12 may not be rotated once the wedge 18 has been driven into the ground. Furthermore, the vertical post 12 usually may not be lifted straight out of the ground due to interaction between the auger 16 and the earth. Therefore, the sign may not be removed until the retaining device 28 is removed, allowing the wedge 18 to be lifted out of the earth, and thereby allowing the vertical post 12 to be turned in a counter-clockwise direction to unscrew the auger 16 from the earth. This greatly reduces the occurrence of sign theft.

Figure 2:
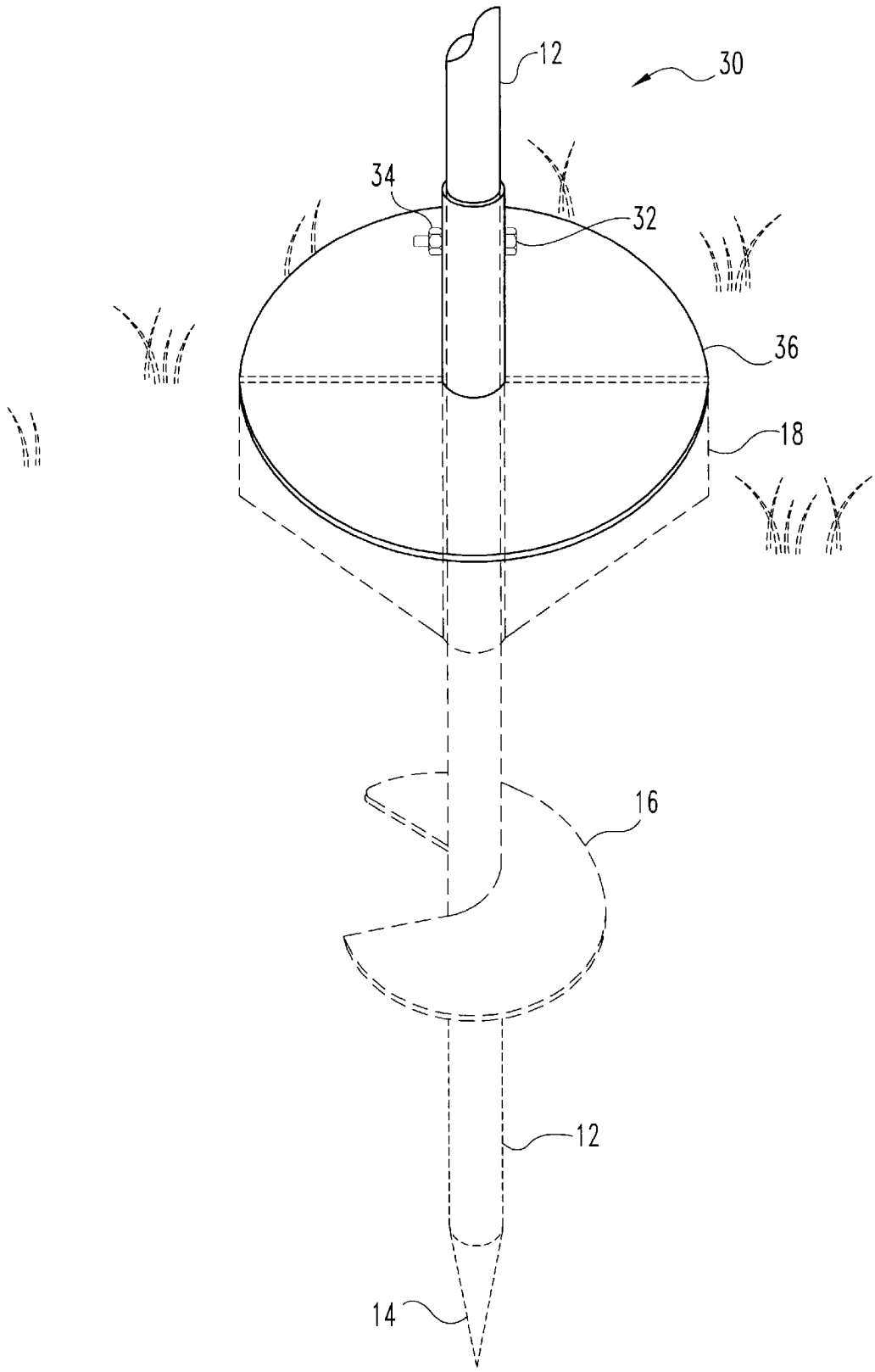
FIG. 2 is a perspective view of a second embodiment of the present invention mounted into the ground.

Although the slidable locking wedge 18 is illustrated in FIG. 1 as being secured to the vertical post 12 by means of a padlock 28, the present invention comprehends the use of any structure to couple the wedge 18 to the post 12. For example, a second embodiment of the anchor locking device 30 is illustrated in FIG. 2, and in this embodiment, the wedge 18 is secured to the vertical post 12 by means of a bolt 32 and a nut 34. Although not a lock, the bolt 32/nut 34 combination requires tools and a certain amount of time to be employed in their removal, thereby deterring most would-be thieves due to the increased odds of being caught while spending the extra time to disassemble the sign. Other similar couplings may be used, such as a cotter pin, a length of wire, chain, and the like.

The second embodiment anchor locking device 30 of FIG. 2 further includes a round disc 36 positioned on the sliding lockable wedge 18 such that the disc 36 lies flush with the ground surface once the anchor locking device 30 has been installed. The disc 36 may be formed integrally with the wedge portion 18 or may be a separate piece mounted thereon. Furthermore, the disc 36 may have any shape, however, a circular disc is preferred. The disc 36 provides increased surface area for driving the wedge 18 into the earth's surface. Additionally, the disc 36 is useful in applications where the anchor locking device 30 is inserted into an area having mowed grass. The disc 36 covers up the grass immediately surrounding the vertical post 12, thereby preventing the need to mow the grass immediately surrounding the vertical post. As most lawnmowers are incapable of mowing all of the grass around such a vertical post, the disc 36 prevents the need for additional trimming after the lawn mowing operation.

It will be appreciated that while the anchor locking devices 10 and 30 of FIGS. 1 and 2 are suitable for the secure mounting of a sign or the like, they may find application in numerous other areas. Because the anchor locking device of the present invention forms a securely anchored post into the ground that is not easily removed, the anchor locking device of the present invention may be coupled to anything that is desired to be anchored. For instance, the anchor locking device of the present invention may be attached to park benches, picnic tables, portable grills, garbage cans, and other items that are accessible to the public in order to prevent the unauthorized removal of these items. The anchor locking device of the present invention may therefore be used to secure any article in order to prevent theft or vandalism of the article.

Figure 3:
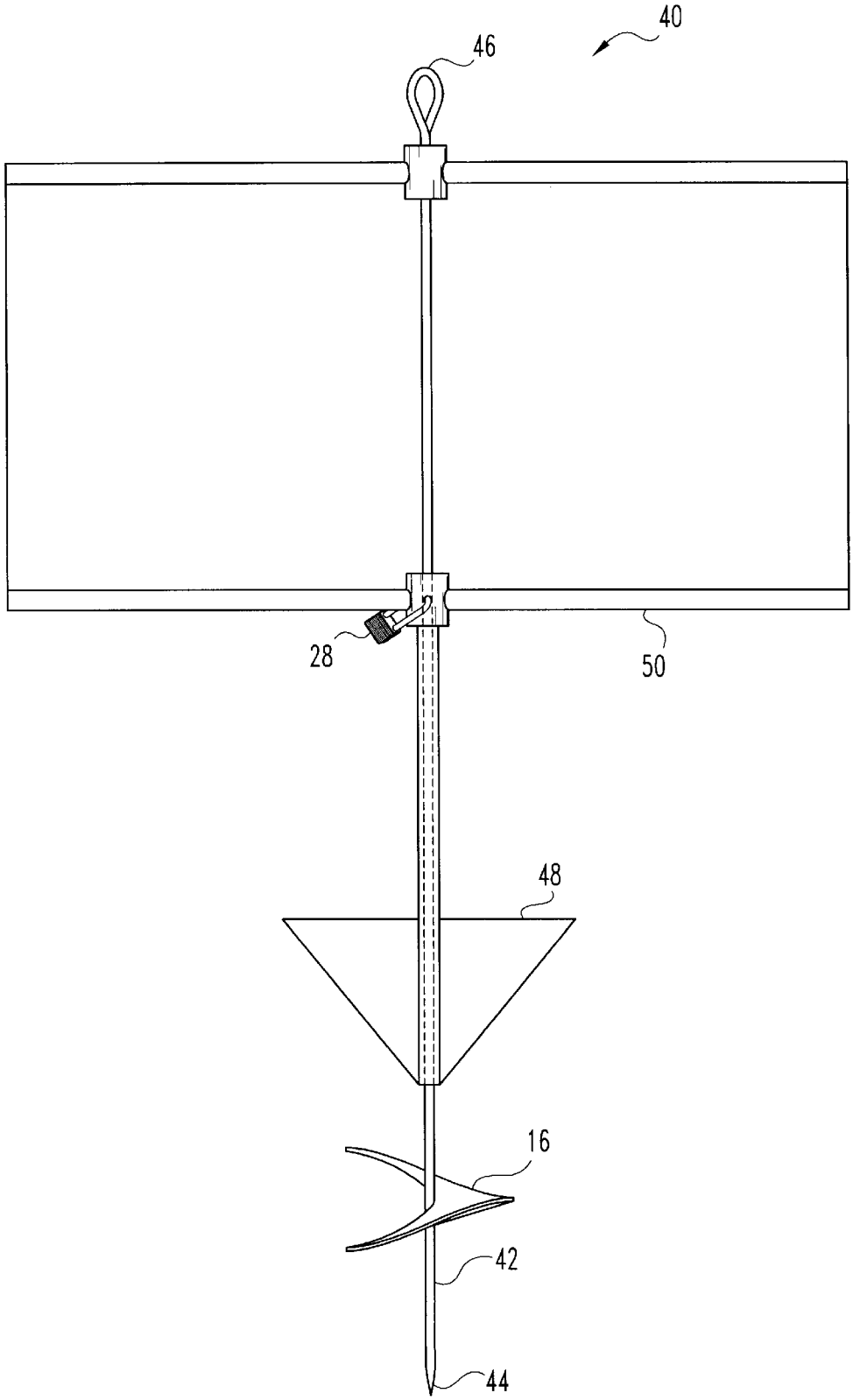
FIG. 3 is side elevational view of a third embodiment of the present invention.

Referring now to FIG. 3, there is illustrated a third embodiment anchor locking device of the present invention formed with a sign frame and indicated generally at 40. The anchor locking device 40 includes a vertical post 42 having a pointed distal end 44 thereon and a proximal end 46 formed into an eyelet. An auger or drill flight surface 16 is formed on the vertical post 42 and functions as described hereinabove. The eyelet 46 at the proximal end of the vertical post 42 may be used to facilitate screwing the auger 16 into the earth, as a rod or the like (not shown) may be inserted therethrough to be used as a lever handle. Those of ordinary skill will recognize that, while an eyelet 46 has been described, various devices such as a hex nut head, a T-handle, and the like may be used in place of the eyelet 46 to facilitate screwing the auger 16 into the earth with the aid of leverage.

The anchor locking device 40 further includes a sliding lockable wedge portion 48 that may be attached to or integrally formed with a sign frame 50. The wedge portion 48 and sign frame 50 are each adapted to slide upon the vertical post 42. The anchor locking device 40 of FIG. 3 is installed into the ground in a manner analogous to that described hereinabove with respect to FIG. 1. Once the auger 16 has been positioned to the desired depth, the wedge portion 48 may be forced into the ground and secured to the vertical post 42 by means of a retaining device 28, such as a padlock. This securing step then locks the sign frame 50 in place in the case when the sign frame 50 is integrally formed with the sliding lockable wedge portion 48. Similarly, the sign frame 50 may be secured to the vertical post 42 by means of a frictional retainer (not shown) such as a spring-loaded collar, a screw, or a nut, or by means of a second retaining device in another preferred embodiment (not shown) when the sign frame 50 defines diametrically opposed holes therethrough capable of being aligned with the holes of the vertical post 42.

Figure 4:
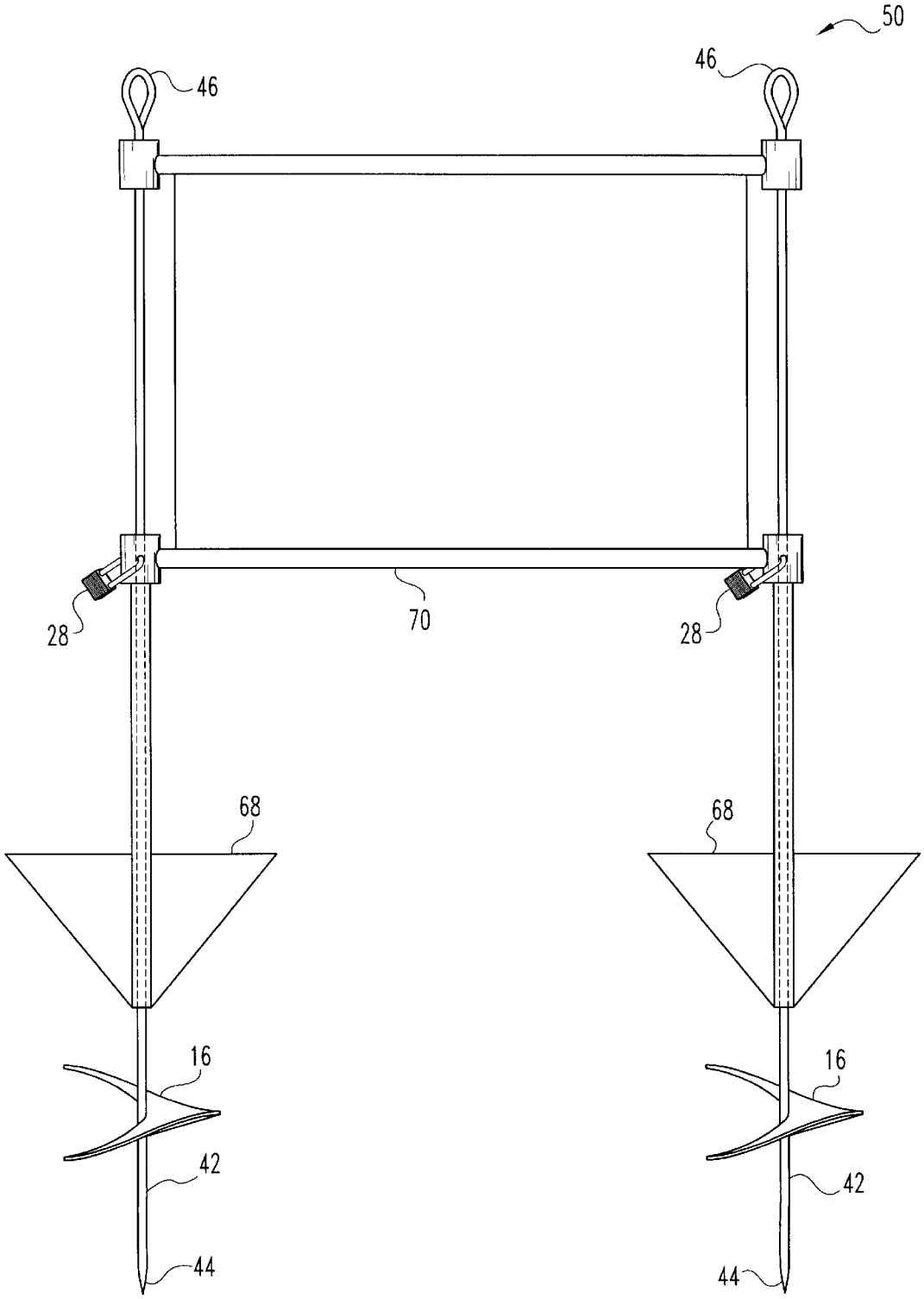
FIG. 4 is a side elevational view of a fourth embodiment of the present invention.

A fourth embodiment of the present invention is illustrated in FIG. 4, and indicated generally at 60. The device 60 is a sign having two mounting posts, in which each mounting post has a separate auger 16 and slidable locking wedge portion 68. An integral sign portion 70 is coupled to both sliding wedge portions 68. The sliding wedge portions 68 may be secured to both vertical posts 42. Alternatively, the device 60 of FIG. 4 may utilize the auger 16 and slidable locking wedge device 68 on only one of its two posts, the remaining post comprising only the vertical post 42. Even with only one wedge portion 68, removal of the sign 60 by unauthorized persons is still prevented.

It will be appreciated from the above description that the anchor locking device of the present invention offers significant advantages over prior art devices. No prior art device offers the desirable combination of features including a screw auger for ease of insertion of the post into the ground, a wedge portion for prevention of inadvertent twisting of a sign mounted to the post, and a coupling between the wedge portion and the vertical post which discourages or prevents unauthorized removal of the anchor locking device from the ground. All of these features are conveniently provided for in the present invention.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An anchor locking device comprising:

a vertical post having a first end and a second end, said first end being adapted to pierce a ground surface, said vertical post having a generally spiral surface affixed to an exterior surface of said vertical post adjacent said first end and said vertical post defining at least one hole therethrough;

a wedge portion coaxially mounted in sliding relationship with said vertical post, said wedge portion defining a collar portion and at least one vertical fin mounted on said collar portion, said collar portion defining at least one hole therethrough and said at least one vertical fin being adapted to pierce said ground surface; and a retaining device adapted to pass through said at least one hole in said collar portion and through said at least one hole in said vertical post to thereby releasably prevent substantial relative motion between said wedge portion and said vertical post.

2. The anchor locking device of claim 1, and further comprising:

a plate, said plate being positioned on said wedge portion such that when said retaining device is releasably preventing relative motion between said wedge portion and said vertical post, said plate lies parallel to and substantially flush with said ground surface.

3. The anchor locking device of claim 1, wherein said retaining device is at least one selected from the group comprising: a padlock, a chain, a wire, a nut and a bolt, and a cotter pin.

4. The anchor locking device of claim 1, wherein said generally spiral surface is one selected from the group comprising: a drill flight, an auger, and a screw.

5. The anchor locking device of claim 1, wherein said at least one vertical fin is at least one selected from the group comprising: a pin, a stake, a plate, a fin, a cylinder, a cone, and a tine.

6. The anchor locking device of claim 1, wherein said second end of said vertical post comprises a lever device.

7. The anchor locking device of claim 6, wherein said lever device is at least one selected from the group comprising: a T-handle, a hex nut head, and an eyelet.

8. The anchor locking device of claim 1, and further comprising:

an outdoor item; wherein said retaining device is capable of attaching to said outdoor item; and further wherein said retaining device releasably prevents substantial relative motion between said outdoor item and said vertical post when when said retaining device is releasably preventing relative motion between said wedge portion and said vertical post.

9. The anchor locking device of claim 1, and further comprising:

a sign frame, said sign frame being coaxially mounted in sliding relationship with said vertical post, and including at least one frictional retainer adapted to secure said sign frame to said vertical post.

10. The anchor locking device of claim 1, and further comprising:

a sign frame, said sign frame being integrally formed with said wedge portion and coaxially mounted in sliding relationship with said vertical post.

11. The anchor locking device of claim 1, and further comprising:

a sign frame, said sign frame being coaxially mounted in sliding relationship with said vertical post and defining at least one pair of diametrically opposed holes therethrough adapted to align with at least one second hole in said vertical post; and at least one second retaining device adapted to pass through said pair of diametrically opposed holes and through said at least one second hole in said vertical post to thereby releasably prevent substantial relative movement between said sign frame and said vertical post.

12. The anchor locking device of claim 1, and further comprising:

a second vertical post;

a sign frame, said sign frame being coaxially mounted in sliding relationship with said vertical post and said second vertical post and defining at least one pair of diametrically opposed holes therethrough adapted to align with at least one second hole in said vertical post; and at least one second retaining device adapted to pass through said pair of diametrically opposed holes and through said at least one second hole in said vertical post to thereby releasably prevent substantial relative movement between said sign frame and said vertical post.

13. The anchor locking device of claim 1, and further comprising:

a second vertical post having a first end and a second end, said first end being adapted to pierce a ground surface, said second vertical post having a generally spiral surface affixed to an exterior surface of said second vertical post adjacent said first end and said second vertical post defining at least one hole therethrough;

a second wedge portion coaxially mounted in sliding relationship with said second vertical post, said second wedge portion defining a collar portion and at least one vertical fin mounted on said collar portion, said collar portion defining at least one hole therethrough and said at least one vertical fin being adapted to pierce said ground surface; and a second retaining device adapted to pass through said at least one hole in said collar portion and through said at least one hole in said second vertical post to thereby releasably prevent substantial relative motion between said second wedge portion and said second vertical post.

14. The anchor locking device of claim 13, and further comprising:

a sign frame, said sign frame being coaxially mounted in sliding relationship with said vertical post and said second vertical post and defining at least one first pair of diametrically opposed holes therethrough adapted to align with at least one second hole in said vertical post and at least one second pair of diametrically opposed holes therethrough adapted to align with at least one second hole in said second vertical post;

at least one third retaining device adapted to pass through said first pair of diametrically opposed holes and through said at least one second hole in said vertical post to thereby releasably prevent substantial relative motion between said sign frame and said vertical post; and at least one fourth retaining device adapted to pass through said second pair of diametrically opposed holes and through said at least one second hole in said second vertical post to thereby releasably prevent substantial relative motion between said sign frame and said second vertical post.

15. The anchor locking device of claim 1, and further comprising:

a second vertical post; and a sign frame, said sign frame being integrally formed with said wedge portion and coaxially mounted in sliding relationship with said vertical post and said second vertical post.

16. The anchor locking device of claim 1, and further comprising:

a second vertical post; and a sign frame, said sign frame being coaxially mounted in sliding relationship with said vertical post and said second vertical post, and including at least one frictional retainer adapted to secure said sign frame to said vertical post.

17. A sign locking device comprising:

at least one vertical post having a first end and a second end, said first end being adapted to pierce a ground surface, said at least one vertical post having a generally spiral surface affixed to an exterior surface of said at least one vertical post adjacent said first end and said at least one vertical post defining at least one hole therethrough;

a wedge portion coaxially mounted in sliding relationship with said at least one vertical post, said wedge portion defining a collar portion and at least one vertical fin mounted on said collar portion, said collar portion defining at least one hole therethrough and said at least one vertical fin being adapted to pierce said ground surface;

a retaining device adapted to pass through said at least one hole in said collar portion and through said at least one hole in said at least one vertical post to thereby releasably prevent substantial relative motion between said wedge portion and said at least one vertical post; and a sign frame, said sign frame being integrally formed with said wedge portion and coaxially mounted in sliding relationship with said at least one vertical post.

18. A method of anchoring an outdoor item to a ground surface comprising the steps of:

(a) providing an outdoor item;

(b) providing a ground surface;

(c) providing a locking anchor assembly comprising:

(i) a vertical post having a first end and a second end, said first end being adapted to pierce said ground surface, said vertical post having a generally spiral surface affixed to an exterior surface of said vertical post adjacent said first end and said vertical post defining at least one hole therethrough;

(ii) a wedge portion coaxially mounted in sliding relationship with said vertical post, said wedge portion defining a collar portion and at least one vertical fin mounted on said collar portion, said collar portion defining at least one hole therethrough and said at least one vertical fin being adapted to pierce said ground surface; and (iii) a retaining device adapted to pass through said at least one hole in said collar portion and through said at least one hole in said vertical post and capable of attaching to said outdoor item;

(d) driving said vertical post into said ground surface until said generally spiral surface contacts said ground surface;

(e) screwing said generally spiral surface into said ground surface to a desired depth;

(f) sliding said wedge portion down said vertical post until said wedge portion contacts said ground surface;

(g) pressing said at least one vertical fin completely into said ground surface;

(h) aligning said at least one hole in said collar portion with said at least one hole in said vertical post;

(i) attaching said retaining device to said outdoor item; and (j) passing said retaining device through the now-aligned at least one hole in said collar portion and at least one hole in said vertical post to thereby releasably prevent substantial relative motion between said wedge portion and said vertical post and between said outdoor item and said ground surface.

* * * * *

UNITED STATES PATENT AND TRADEMARK OFFICE

CERTIFICATE OF CORRECTION

PATENT NO : 5,881,978

DATED : March 16, 1999

INVENTOR(S) : Marcus D. Rust

It is certified that error appears in the above-identified patent and that said Letters Patent are hereby corrected as shown below:

In column 2, line 12, please delete second "when".

In column 2, line 13, please change "farther" to --further--.

In column 2, line 67, please change "fins 12" to --fins 22--.

Signed and Sealed this

Fourteenth Day of December, 1999

*Attest:*

Q. TODD DICKINSON

*Attesting Officer*

*Acting Commissioner of Patents and Trademarks*